US005489886A

United States Patent [19]

Wexler et al.

[11] Patent Number: 5,489,886

[45] Date of Patent: Feb. 6, 1996

[54] AUTOMATIC LINE OFFICIATING SYSTEM AND METHOD THEREOF

[75] Inventors: Gil Wexler, Tel Aviv; Alexander Steinberg, Haifa, both of Israel

[73] Assignee: Alos-Officiating Tennis System Limited, Givat Shmuel, Israel

[21] Appl. No.: 101,889

[22] Filed: Aug. 4, 1993

[30] Foreign Application Priority Data

Aug. 7, 1992 [IL] Israel ..... 102755

[51] Int. Cl.[6] ..... G08B 23/00

[52] U.S. Cl. ..... 340/323 R; 273/29 R; 364/410; 348/157

[58] Field of Search ..... 340/323 R; 273/29 R; 364/410, 411; 358/105, 108

[56] References Cited

U.S. PATENT DOCUMENTS

| | | | |
|---|---|---|---|
| 3,810,148 | 5/1974 | Karsten et al. | 340/323 R |
| 4,183,056 | 1/1980 | Evans et al. | 340/323 R |
| 4,422,647 | 12/1983 | Wilson | 273/411 |
| 4,432,058 | 2/1984 | Supran | 364/410 |
| 4,545,576 | 10/1985 | Harris | 273/25 |
| 4,718,669 | 1/1988 | Carlton | 273/29 R |
| 4,797,738 | 1/1989 | Kashi | 358/101 |
| 4,814,986 | 3/1989 | Spielman | 364/410 |
| 4,866,414 | 9/1989 | Diaconu | 340/323 R |
| 4,893,182 | 1/1990 | Gautraund | 358/105 |
| 5,059,944 | 10/1991 | Carmona | 340/323 R |
| 5,082,263 | 1/1992 | Berger | 273/29 R |

OTHER PUBLICATIONS

Anil J. Jain, "Fundamentals of Digital Image Processing," Prentice Hall Information and System Science Series, Chapter 7, pp. 233–255.

John Canny, "A Computational Approach to Edge Detection," IEEE Transactions on Pattern Analysis and Machine Intelligence, vol. PAMI-8, No. 6, Nov., 1986, pp. 679–697.

J. Illingworth and J. Kittler, "A Survey of the Hough Transform," Academic Press, Inc., 1988, pp. 87–115.

*Primary Examiner*—John K. Peng
*Assistant Examiner*—Daryl C. Pope
*Attorney, Agent, or Firm*—Townsend and Townsend Khourie and Crew

[57] ABSTRACT

An automatic line officiating system including a video camera and associated optics and electronics disposed adjacent to a line to be officiated and arranged with the longitudinal axis of its field of view concentric with the line and adapted to provide image data representing the vicinity of the line and a central processing system coupled to the video camera and arranged to receive the image data from the camera, to process the data to determine the path of the ball before, during and after a bounce, and to provide an indication whether the ball has bounced on or within the line, or outside the line.

8 Claims, 9 Drawing Sheets

AUTOMATIC LINE OFFICIATING SYSTEM AND METHOD THEREOF

BACKGROUND OF THE INVENTION

An officiating team for a tennis match is composed of up to twelve personnel, of whom ten serve as court line-judges. It may seem excessive to find two players surrounded by ten line-judges on the court, but careful examination of the line-judging task readily explains why so many judges are needed. With players using state of the art racquet technology, a tennis ball may travel as fast as 50 meters per second. At this velocity the human eye and brain are not agile enough to respond and determine the exact location of the ball's impact on the ground. An official can know for certain whether the ball has bounced inside or outside the court only he is seated along the particular court line for which he is responsible. Since there are up to ten court lines to officiate, important matches are usually manned with that many line-judges. Due to the particularly high velocity of a service hit, moreover, faultless base line officiating of the service zone, even with all this personnel, is not possible without the assistance of an auxiliary apparatus.

Many ways to replace line-judges have been suggested:

U.S. Pat. No. 4,866,414 removes the burden of human line-judging by assigning optical line watch units to each of the court lines, but it places part of the units on the court itself and requires the players to wear socks and shoes of non-white colors.

U.S. Pat. No. 5,059,944 also describes an optical system for detecting and signaling a ball-out-of-bounds condition on a tennis court. In this patent, an optical shape-plane interfered with by a ball disables an underlying optical timed plane. The timed plane discriminates between an interference caused by a player's body or racquet and one caused by a ball. There is, however, no visual feedback on the system, and in any case, it is not precise enough for reliable officiating.

U.S. Pat. No. 4,422,647 suggests a way of detecting and indicating that a volleyball is out of bounds, utilizing a light beam system that distinguishes between the volleyball and other beam disrupting agents. The deficiency of this patent seems to be that the timer requires exact simultaneous interruption of both beams to prevent the system from indicating an out-of-bounds condition.

U.S. Pat. No. 4,814,986 describes a device for monitoring the relative point of impact of an object in flight proximate to a reference line on a surface. At least one plane of radiated energy, preferably light beams, is pre-positioned with respect to the reference line. Detectors, preferably photodetectors, provide signals indicative of the relative elevation of the object at two successive points in time-based intersection of at least one plane of energy radiated by the object. The system does not, however, provide a means of differentiating between ball and player or ball and racquet. It is therefore only applicable for officiating of the service zone.

U.S. Pat. No. 4,718,669 offers an electrically operated line monitor for tennis. It uses one or more rays substantially smaller than a ball in effective cross section, in order to monitor areas adjacent to critical lines of a court. As with U.S. Pat. No. 4,814,986, cited above, however, this invention does not provide a means of differentiating between ball and player or ball and racquet, and is likewise only applicable for officiating the service zone.

U.S. Pat. No. 5,082,263 claims a tennis ball that contains a radar signal reflecting element, so that a computer can compare a radar signal, sent to and received from the ball, with a stored position of the court, thereby determining the relative position of the ball. The obvious drawback of this invention is the required change in the design of the ball.

U.S. Pat. No. 4,432,058 describes an automated tennis officiating system that analyzes effects of the bounce of the ball. This patent utilizes pattern recognition in order to determine whether the detected bounce was actually a valid bounce of a ball and not caused by other events. The invention has two drawbacks: the court must be laid out with electrical circuits that define "in" and "out" areas of the court, and the ball must be electrically conductive.

U.S. Pat. No. 4,893,182 claims an imaging processing system for displaying a succession of selected separate images of a moving object, but in an otherwise substantially static scene, like a bowling alley. Such a patent is not applicable to a tennis game.

U.S. Pat. No. 4,545,576 describes an apparatus and method to compute the trajectory of a moving object by remote, non-interfering sensors. The particular application, based on video cameras, computes the trajectory of a pitched baseball throughout its flight. The apparatus is required, among others things, to identify the ball and compute its location in three dimensions as a function of time. The precision that can be achieved in computing the position of the ball, however, is not sufficient for the game of tennis.

Finally, U.S. Pat. No. 4,797,738 claims a color recognition apparatus that uses a video image, represented by a color difference signal and photographed by a color television camera or similar device. The apparatus makes a determination whether or not these signals fall within a predetermined region. Natural variation in illumination of the ball is problematic, however, and regardless, the precision is insufficient in this patent as well.

As described above, all of the prior art solutions remain wanting in some respect. Some are quite cumbersome and require substantial changes in the playing court or tennis ball. Others impose restrictions on the players' clothing. Still others cannot handle the dynamics of a modern tennis game. In short, none of them are fully satisfactory for use with current conventionally acceptable professional practice.

The present invention, in contrast, provides a fully satisfactory system for automatic line officiating. It is operated by a single person, the referee, and it can determine the exact point on the ground where the ball has bounced.

BRIEF DESCRIPTION OF THE DRAWINGS

The present invention will be further understood, from the following detailed description taken in conjunction with the drawings wherein.

SUMMARY OF THE INVENTION

Figure 1:
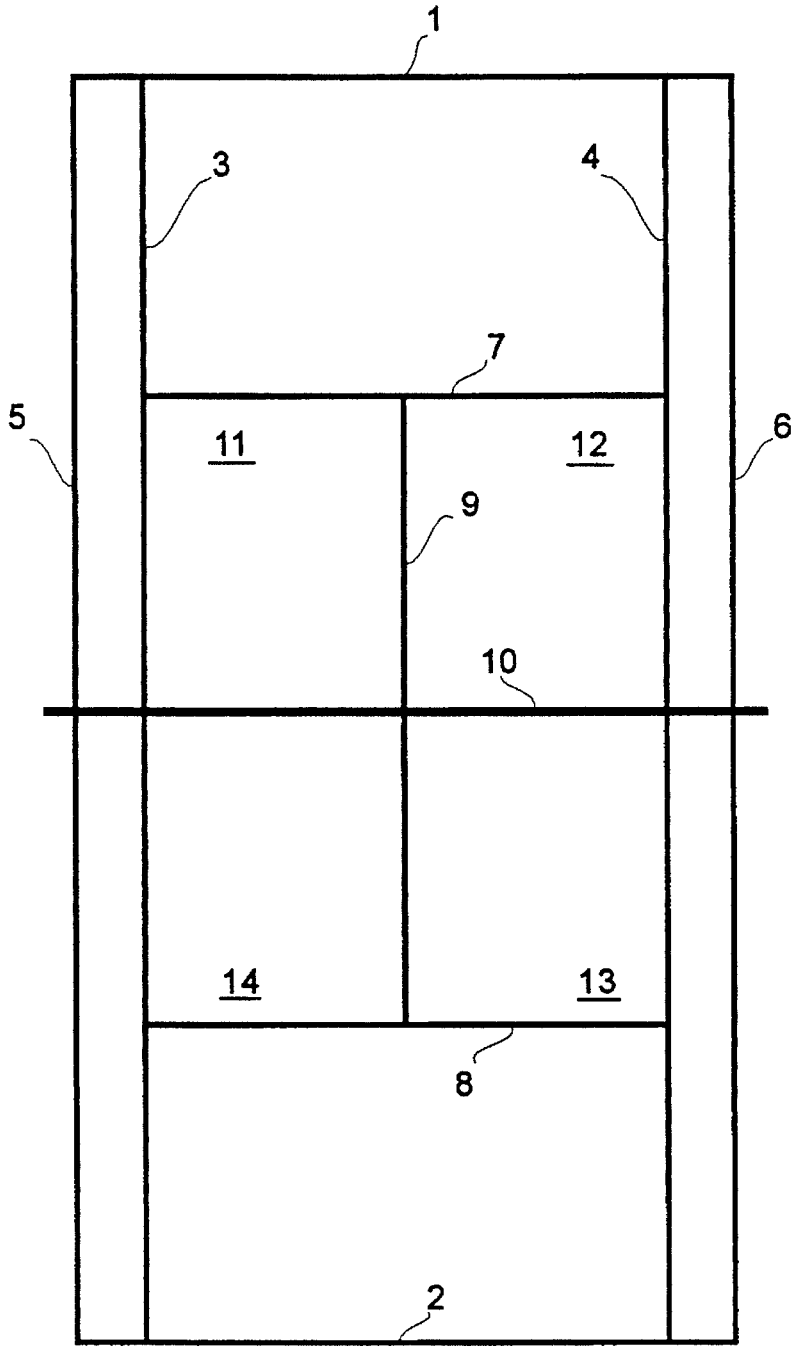
FIG. 1 illustrates a tennis court.

It is an object of the invention to provide an automatic line officiating system (ALOS) and method which is easy to operate and assemble, and relatively inexpensive to manufacture.

It is another object of the invention to provide a system and method for accurate on-the-spot determination of the location of the ball's impact on the ground, so as to provide an automatic line officiating means for tennis.

It is yet another object of the invention to provide a system and method wherein the said ball impact is determined relative to all the court lines for each impact of the ball in the match, and thus to replace all the line-judges.

A further object of the invention is to provide an ALOS with minimal interference of the game court and with a minimal officiating team.

A still further object of the invention is to provide an ALOS that can be hooked into conventional video or television devices, so as to allow combining or composing of the data or picture produced by the ALOS with conventional television or video filming of a tennis match.

Yet a further object of the invention concerns the application of the ALOS to similarly problematic games wherein determination of the ball-to-ground impact relative to a line is required.

In accordance with this invention there is provided an automatic line officiating system (ALOS) comprising:

a video camera and associated optics and electronics disposed adjacent to a line to be officiated, and arranged with the longitudinal axis of its field of view concentric with said line and adapted to provide image data representing the vicinity of said line; and a central processing system coupled to said video camera, and arranged to receive said image data from the camera, to process said data to determine the path of the ball before, during, and after a bounce, and to provide an indication whether the ball has bounced on or within said line, or outside said line.

There is also provided a method for automatic line officiating comprising the steps of:

mounting a video camera and associated optics and electronics adjacent to a line to be officiated with the longitudinal axis of its field of view concentric with said line;

providing image data from the camera's field of view to a central processing system coupled to said video camera;

processing said image data to provide data corresponding to the path of the ball as it bounces in the vicinity of said line; and providing, in response thereto, an indication of whether the ball has bounced on or within said line, or outside said line.

DESCRIPTION OF A PREFERRED EMBODIMENT

The present invention relates to apparatus and method for officiating a line in any sport requiring a determination whether a bouncing ball has bounced on or within a particular court line, or outside thereof. For purposes of example only, the apparatus will be described below with respect to a tennis court, for which the invention is particularly suited. It will be appreciated, however, that this line officiating system can also be utilized in any other game or sport wherein it is important to determine whether a ball or analogous object is "in" or "out" of bounds.

The automatic line officiating system of the present invention for tennis is based on up to 30 video cameras, located mostly out of the game court boundary, along lines to be officiated and under the net dividing the court, as well as an image processing system which processes a set of continuous images of the tennis ball in close proximity to the officiated service or boundary lines.

The system is appropriate for all types of tennis courts, be they grass, clay, or any type of hard surface, and be they indoors or outdoors.

The image processing algorithm is based on a set of images of the ball's trajectory in a way that causes the ball's continuous motion to appear as either a sleeve-like smear or a sequence of rounded objects, which is then compared with the images of the same location taken at prescribed intervals prior to the ball's appearance at the said location. The ball is viewed for a short period of time prior to hitting the ground, at the period of time of contact with the ground, and for a short period of time following the ascension from the point of impact. In each of the time periods the ball motion creates from one or more frames the form of a smeared sleeve.

While the ball is hitting the ground, the image of the ball is elastically deformed and is smeared over the interval in which it is in contact with the ground. The image processing algorithm enables location of the exact position of the white lines in the tennis court and compares their location to the ball's initial point of contact. If there exists a point of contact where part of the ball touches a line of the court or where the ball is inside the court boundaries (or inside the service box boundaries, in the case of a service ball), then the ball is recognized and indicated to be "in."

Both the initial and final point of the said interval are specifically pointed out, and the above mentioned smeared sleeve is outlined, using Computer Generated Symbology (CGS). CGS provides a persuasive on-the-spot visual feedback to the referee and if desired, to the spectators. In addition, when appropriate, it can provide a vocal "out" decision that is easily transmitted over the public announcement system.

FIG. 1 describes and defines the tennis court and is appropriate for both singles matches, where two players face each other, and doubles matches, where each team consists of a pair of players. For singles games the boundaries are as follows: base lines—1 and 2; side lines—3 and 4. For doubles games the base lines are the same as for singles games but the side lines are 5 and 6. For both singles and doubles games the court is divided into two by the net 10. The four service zones 11, 12, 13, and 14 are also the same and their boundaries are as follows:

Service zone 11: between side line 3, central line 9, net 10 and service base line 7.

Service zone 12: between side line 4, central line 9, net 10 and service base line 7.

Service zone 13: between side line 4, central line 9, net 10 and service base line 8.

Service zone 14: between side line 3, central line 9, net 10 and service base line 8.

The specific service zone within which the served ball (the first ball of every play) must fall is the one beyond the net and diagonally across from the server. To be designated "in," the ball must fall within the said boundaries or on the boundary lines themselves. If any part of the ball touches any part of a boundary line then the ball is considered "in."

The apparatus of the present invention includes three basic elements: first, a plurality of subsystems, each containing one or two video cameras with attached electro-optical lenses and electronics; second, a central processing system, which receives the data from the subsystems and determines the location of the ball relative to the court lines; and third, a cuing camera or cameras which serve to identify the specific subsystems which "see" the ball at any given time.

Figure 2:
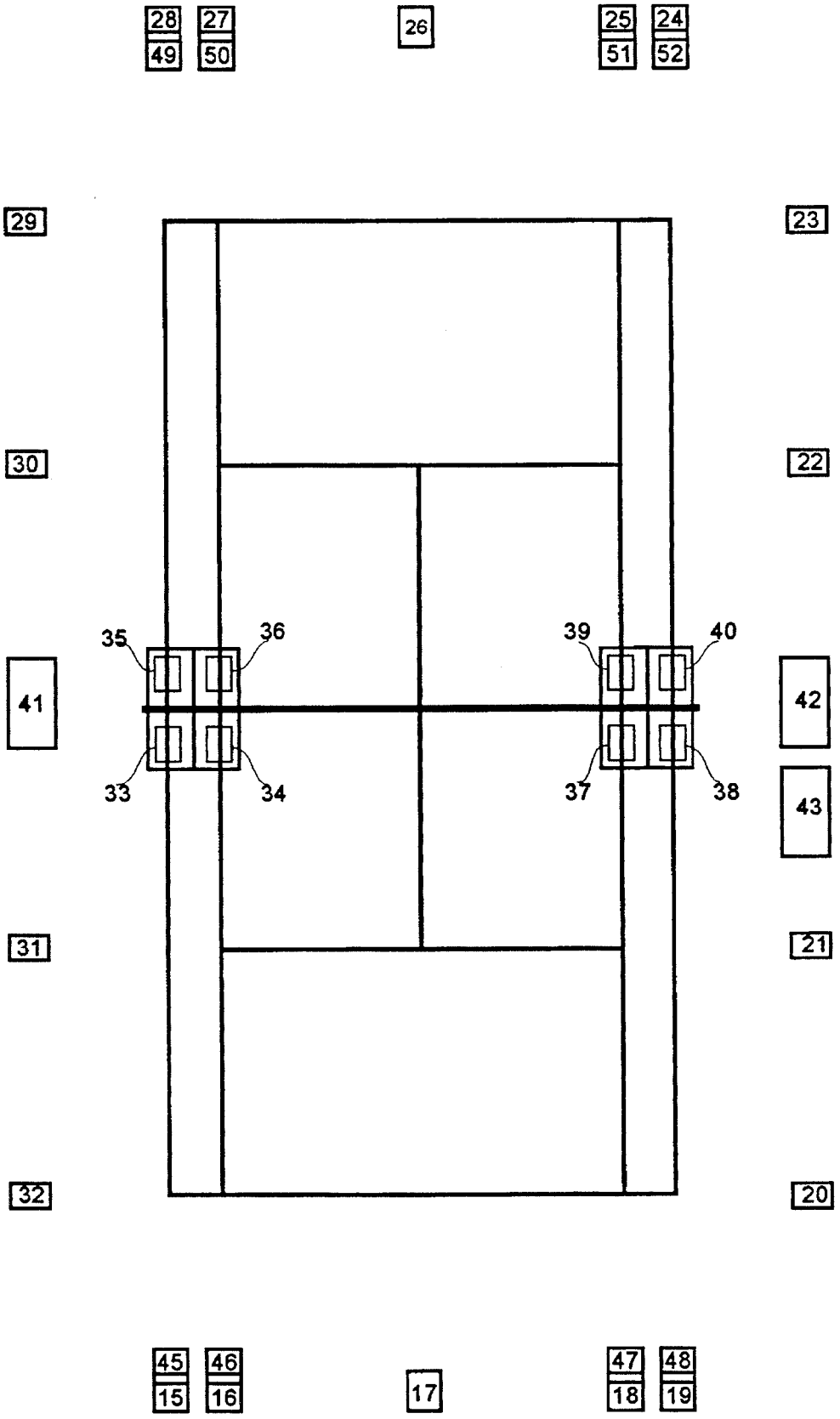
FIG. 2 shows a configuration for the video camera locations according to one embodiment of the invention.

The subsystems are located along each line that is to be officiated, as shown, for example, in FIG. 2. The components of each subsystem are preferably contained in a special round box for protection. The subsystem is firmly attached to the box, which, in turn, is firmly attached to the ground.

The subsystem electronics serve to convert the images in the video camera's field of view from analog to digital form, to define the relevant sequence of images that contain the ball in the field of view, and to transfer the images in turn to the central processing system.

The central processing system includes a computer, and is preferably located near the referee. Its purpose is to give the officiating results and to display the path of the ball as it bounces on the court. An example of a suitable algorithm for the electronics and central processing system is set out below.

The main difficulty of using a video camera to officiate is that the exact point of impact of the ball on the ground usually cannot be captured, due to the camera's relatively low frame rate. The solution in the present invention, however, is to get from the camera a sleeve-like picture containing a rectilinear sleeve or sequence of rounded balls attached to one another. The cameras are set at a controlled exposure and speed to produce the sleeve.

One or more additional cameras may also be used to provide cuing, i.e., to give a decision whether the ball is present or not in the field of view. This variation serves to improve the accuracy of the results, to decrease the time of computation, and to reduce the overall cost of the apparatus.

Among the possible cuing cameras functional in the present invention are the following:

1) A camera with a high frame rate, such as 200 or more frames per second (as opposed to regular video cameras which produce 25 or 30 frames per second)—The field of view for such a cuing camera shall be exactly the same as for the imaging camera. (See, for example, FIG. 7.) During the movement of the ball through the field of view, several pictures, each with the ball located in a different place, are captured and analyzed in order to determine whether or not the ball is present in the field of view.
2) A camera whose shutter is modulated with a different duty-cycle within each field time (20 milliseconds)—In this camera, the modulation opens and closes the shutter several times during each field time in order to get several rounded balls or sleeve-like rectangles, which reflect the speed of the ball and the amount of time the shutter is open, and which possess enough contrast to distinguish them from the background, such as a moving player or a racquet. One or more field times are analyzed in order to determine whether the ball is present therein, and to get a rough estimate of the ball's position of impact on the ground.
3) A camera covering only one line (usually called a line-scan camera)—This camera views a line parallel to and a few centimeters above the ground (e.g., at the height of a ball). The rate of scanning of the line is much higher than in a regular video—on the order of 10,000 lines per second. Through specialized algorithms, such a magnitude of rate of scanning enables the apparatus to recognize the presence of the ball within a field time, and to determine the ball's direction, speed, and expected location of impact on the ground (based on the knowledge of height above the ground).

Each of these cuing cameras is typically a localized camera, placed adjacent to a single line to be observed. It is also possible, however, to use a global cuing camera, which is located high above the court. Such a camera is able to scan the entire court and identify at any given time the imaging cameras towards which the ball is moving.

Reference is now made to FIG. 2, which shows the overall locations of subsystems according to one embodiment of the invention. Boxes 23 and 29 overlook base line 1. Boxes 20 and 32 overlook base line 2. The use of two subsystems arises from the need to prevent the ball from being hidden from a particular line's camera by a player's body or racquet. For a singles game boxes 30 and 31, or 21 and 22, officiate the service base lines. Only one box per service base line is needed since the player receiving the served ball waits on the base line. In a doubles game two boxes—22 and 30 for service base line 7, and 21 and 31 for service base line 8—are still necessary because one of the players of the receiving team sometimes waits on the service base line.

In order to prevent the net, as well as the players, from obscuring the view, the side lines must also be officiated from two ends, on both sides of the court. As described in FIG. 2, two boxes are located near either side line at the back of the court and two are below the net to monitor each side lines from there. For a singles game the boxes below the net are located at 34 and 36 for side line 3 and at 37 and 39 for side line 4. For a doubles game the boxes are located at 33 and 35 for side line 5 and at 38 and 40 for side line 6. The boxes below the net are coupled with boxes beyond the boundaries as follows:

For a singles match: To officiate side line 3, box 36 is coupled with box 27, and box 34 is coupled with box 16. To officiate side line 4, box 39 is coupled with box 25, and box 37 is coupled with box 18.

For a doubles match: To officiate side line 5, box 35 is coupled with box 28, and box 33 is coupled with box 15. To officiate side line 6, box 40 is coupled with box 24, and box 38 is coupled with box 19.

The center line 9 is officiated by box 26 from one side of the net and by box 17 from the other side. The central processing system can be located anywhere, but preferably next to the referee at, for example, location 43.

An optional way to get the side line view without placing boxes below the net is to use an optical means to deflect the view from under the net to cameras in nearby boxes at, for example, locations 41 and 42. Only one box is needed in each of the locations 41 and 42, since the cuing algorithm determines from which side of the court the image to be processed is coming. According to this embodiment, boxes 41 and 42 are located on the lighting posts, or elevated in some other way, so as to act as global cuing cameras, giving an estimate of the direction of ball movement and of the time of the ball crossing the lines.

Figure 3:
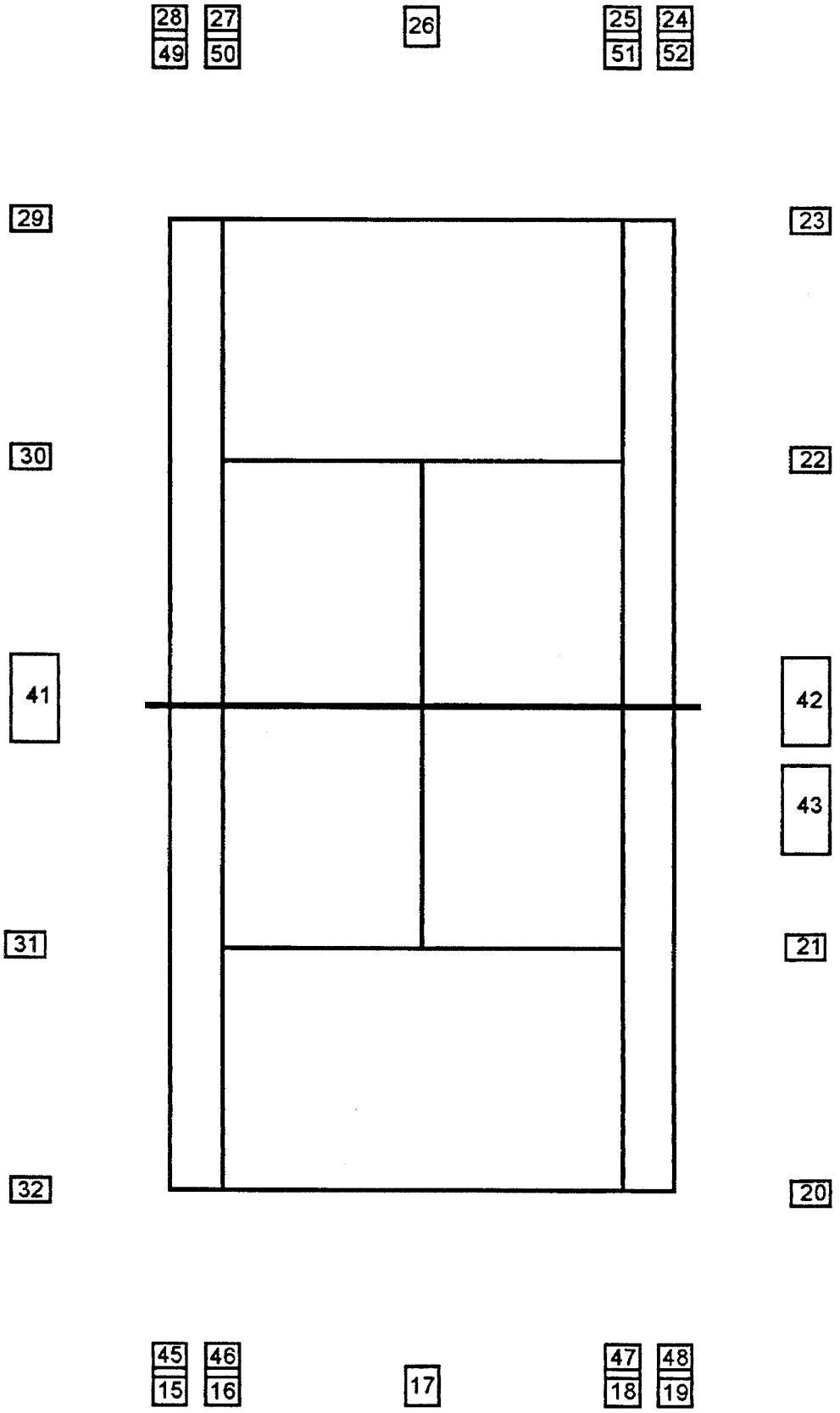
FIG. 3 shows a configuration for the video camera locations according to another embodiment of the invention.

FIG. 3 suggests an alternative configuration, where subsystems below the net are not needed. In this configuration and boxes 33–40 described in FIG. 2 are replaced. For a singles match they are replaced by boxes 46, 47, 50, and 51 located on top of boxes 16, 18, 27, and 25, respectively; for a doubles match, they are replaced by boxes 45, 48, 49, and 52 located on top of boxes 15, 19, 28, and 24, respectively. In the said configuration the cameras located on top are focused to the part of the officiated side line which is beyond the net.

Figure 4:
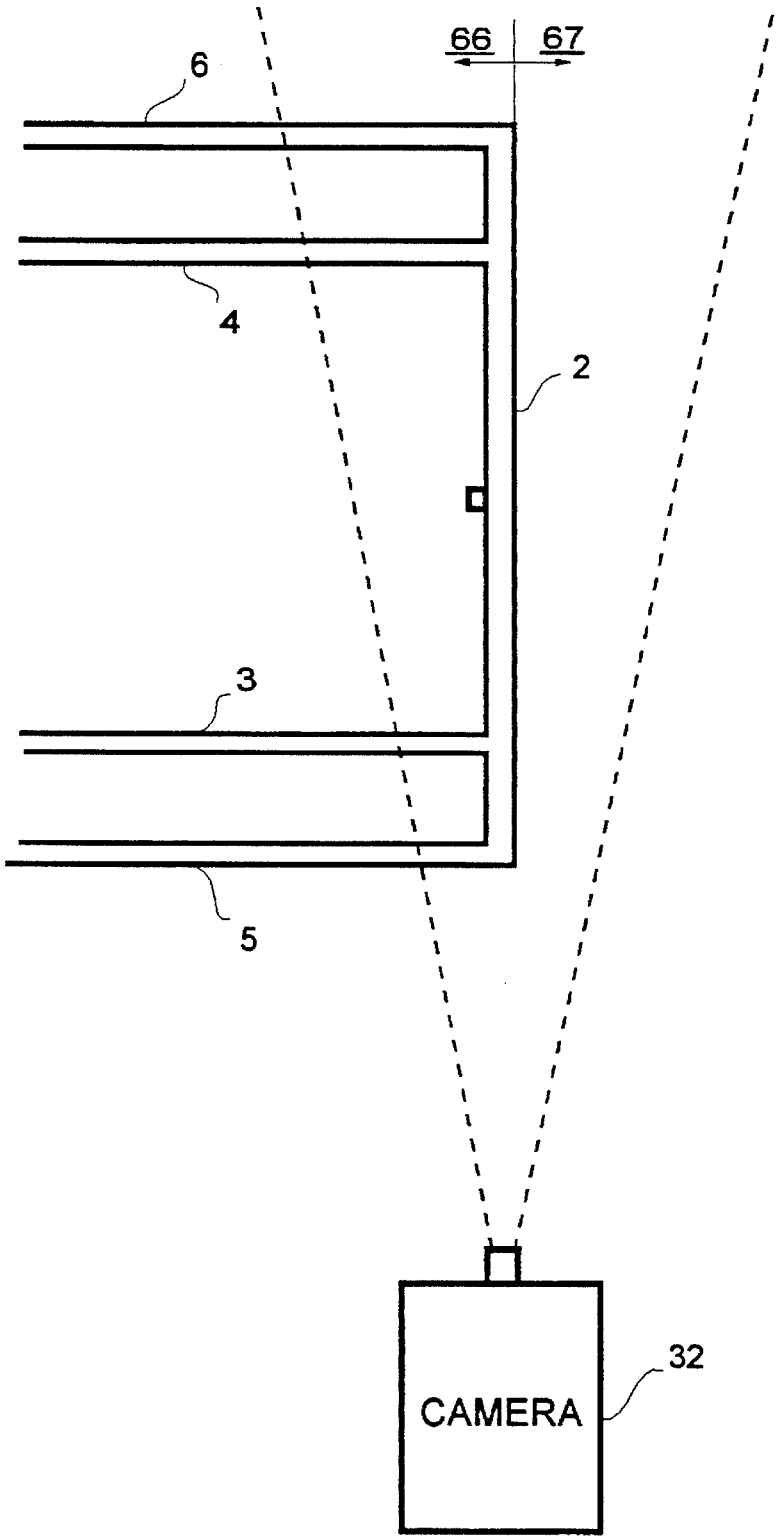
FIG. 4 illustrates the location and operation of a subsystem of the invention relative to a line on a tennis court.
Figure 5:
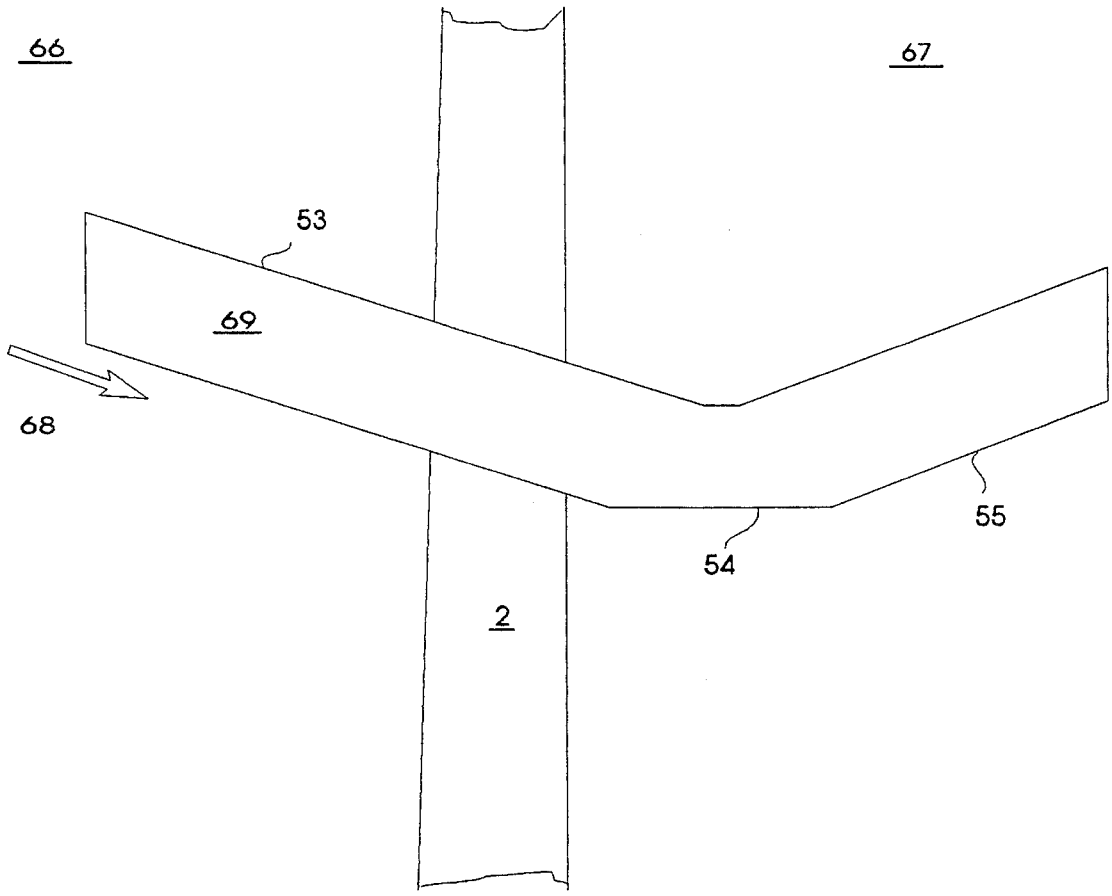
FIG. 5 shows an example of a smeared sleeve for the configuration shown in FIG. 4.

Operation of the apparatus of the present invention is illustrated schematically in FIGS. 4 and 5.

FIG. 4 shows the position of a camera 32 officiating a base line 2. It will be appreciated that a second camera will be disposed at the other end of base line 2 with an overlapping field of view. It is shown that the camera is located exactly along the line and looks at a limited zone, preferably a few hundred millimeters wide on either side of the officiated line. When a cuing camera indicates that the ball is within the field of view of camera 32, its images are sent to and processed by the central processing system.

FIG. 5 illustrates an image picked up by camera 32. The smeared sleeve 69, as can be seen, is composed of three parts: the part prior to the point of impact with the ground 53, the part where the ball hits and slides along the ground 54, and the ascending part 55. The area to the left of and including base line 2 comprises the "in" zone 66. The area to the right of base line 2 comprises the "out" zone 67. Arrow 68 indicates the direction of the path of the ball. In the illustrated case, the ball is "out."

Figure 8:
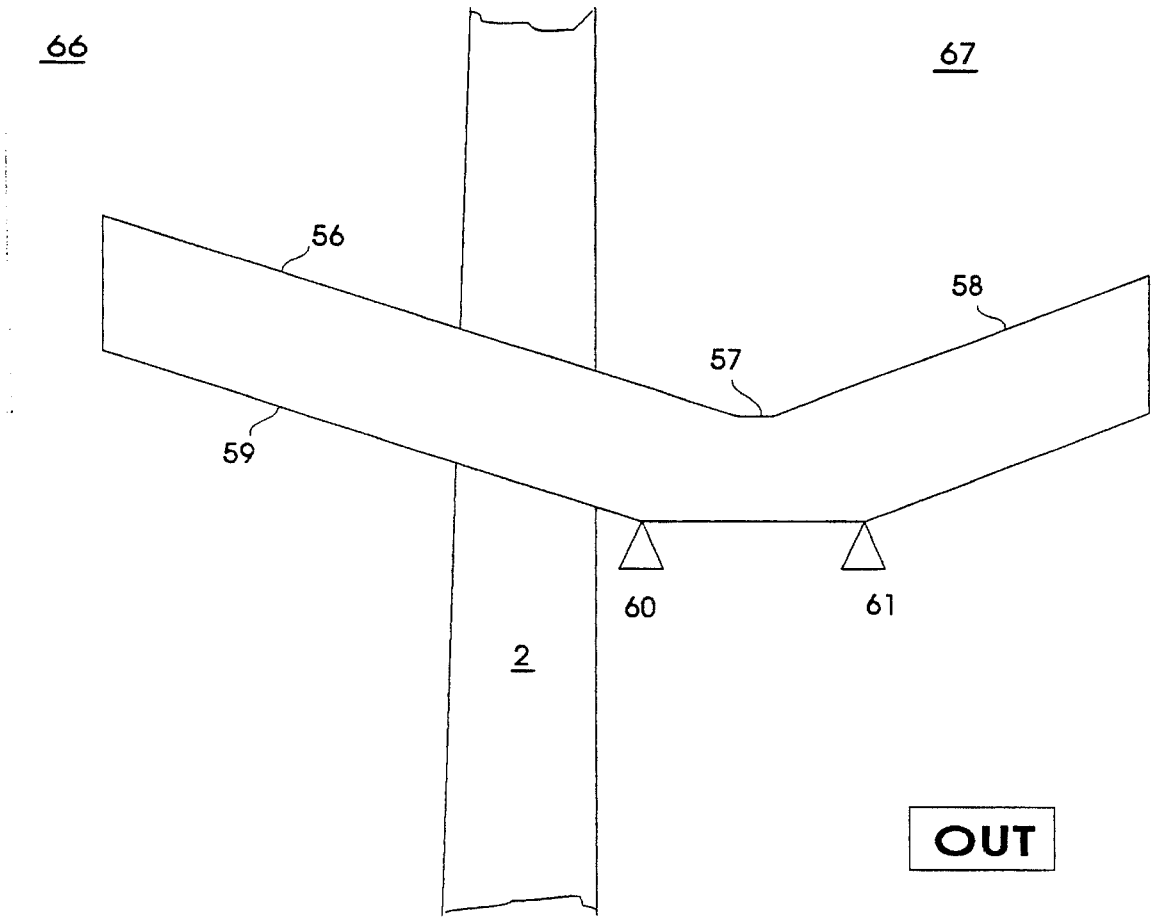
FIG. 8 shows the Computer Generated Symbology additions to a smeared sleeve.

This image is processed further to provide a simplified image which is passed on to the referee's monitor and, if so desired, to in-stadium screens and television viewers. In a manner independent of the image presentation, an "out" indication can be passed on to the public announcement system. An example of the final image is illustrated in FIG. 8, which shows CGS added to the image processed. As described above in FIG. 5, the smeared sleeve is composed of three parts: the part 56 prior to the point of impact with the ground, the part 57 where the ball hits and slides along the ground, and the ascending part 58. The sleeve appears shaded on the monitor, thereby contrasting with the rest of the image. On a color monitor, it appears yellow. A computer generated envelope 59 is added, as are two pointers 60 and 61, indicating the boundaries of the area where the ball was in contact with the ground. If at any point within the said pointers the ball touches the line, or if the ball lands completely inside the appropriate boundaries, it is considered "in." Otherwise it is labeled and indicated as "out." An example of an "out" indication is shown in FIG. 8.

Figure 6:
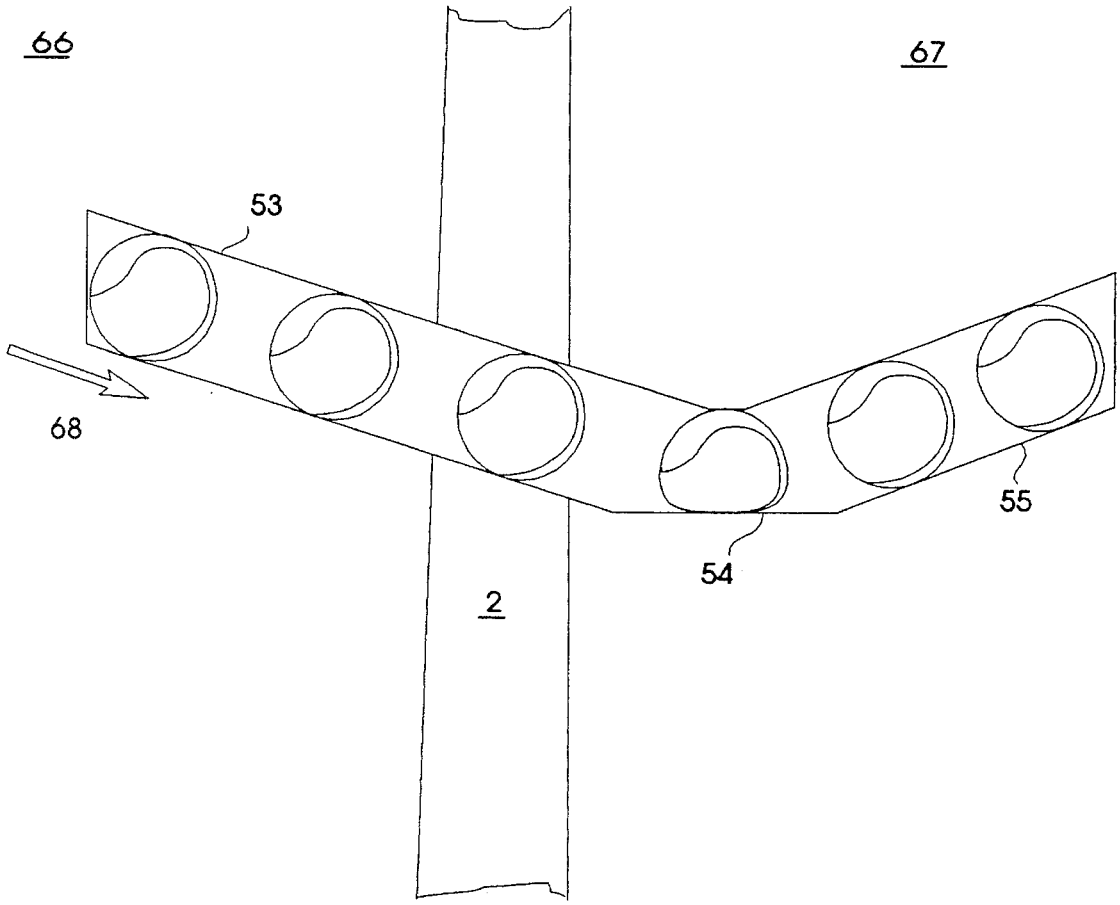
FIG. 6 shows an example of a plurality of balls for the configuration shown in FIG. 4.

According to an alternative embodiment of the invention, the resultant image can be of a plurality of rounded balls attached to one another, instead of a smeared sleeve. FIG. 6 shows an example of such an image. Here, too, CGS is added to provide a simplified image to the referee.

In order to determine near which line or lines the ball is about to bounce, a cuing camera or cameras are provided. Such a camera or cameras may be one or two global cameras mounted at a height above the court, or a number of local cuing cameras, coupled to the subsystems on the court.

Figure 7:
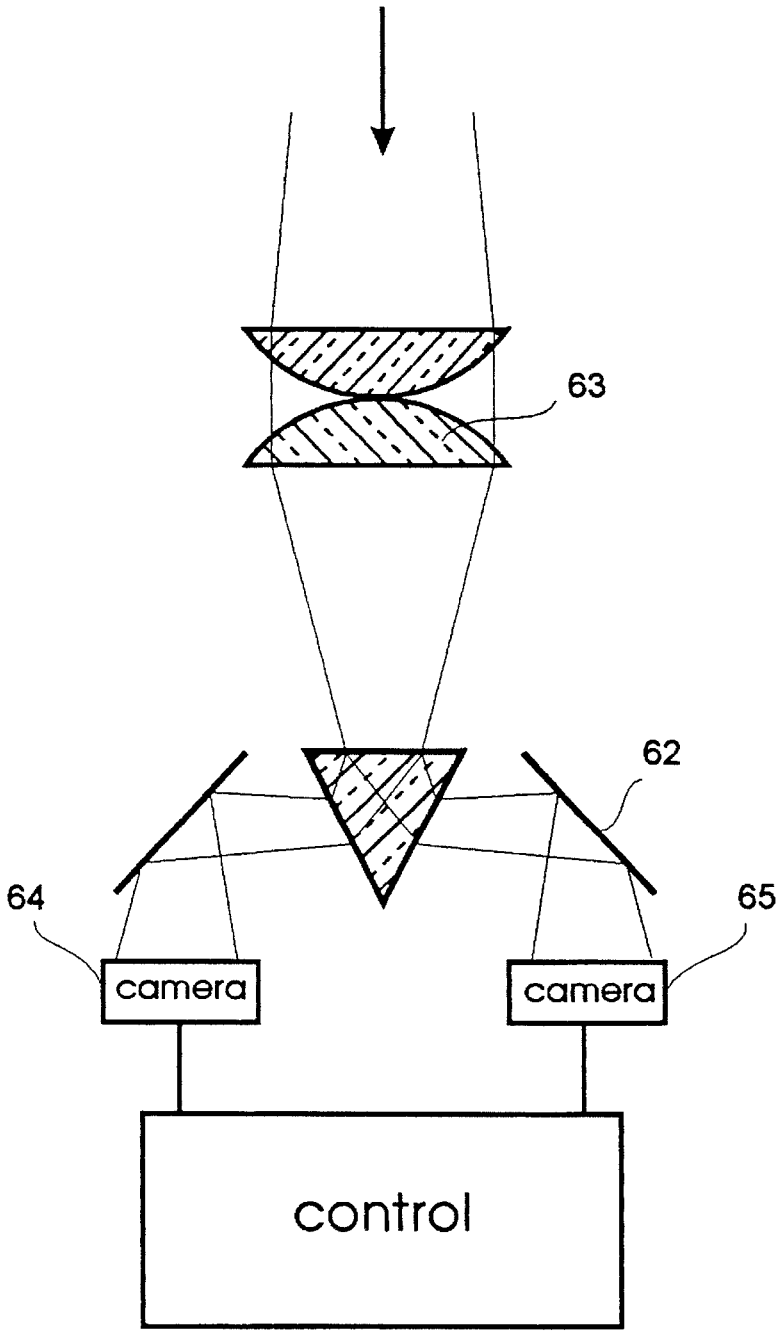
FIG. 7 illustrates a subsystem according to an alternative embodiment of the present invention including a cuing camera.

FIG. 7 illustrates a subsystem according to an alternative embodiment of the present invention including two cameras coupled to the same optics 62. In this case, the lens 63 provides the identical view to both a simple cuing camera 65, which serves only to determine whether the ball is within the field of view, and a video camera 64, which is coupled to the central processing system as described above. Video camera 64 is activated by the cuing camera 65 to transfer its images for processing only when a ball is within the field of view.

Operation of the system consists of four basic stages, listed as follows:

1) The cuing process: In each subsystem, at each frame time (two field times each of 20 milliseconds), testing is done to see whether the ball is present within the image. If the ball is present, a sequence of frames is sent to the central processing system. The sequence contains a few frames received before, as, and after the ball was found.
2) Computation of contact position: Using the transferred sequence of images, the central processing system compares the images of the ball to the line position within the field of view that is continuously analyzed and checked. The place where the ball hits the ground is isolated in a specific image within the sequence. This algorithm is performed on each camera in whose field of view the ball is present, in order to correlate results. The calculation takes into consideration cases where the ball is partially hidden by a player and/or a racquet.
3) Verification of subsystem result: The cameras that view the same line are correlated to verify the ball's "in" or "out" position.
4) Indication of composite result: The composite result is given to the referee within a short time after the event. If any subsystem result is that the ball is "out," then the composite result is "out," and a signal is given to the referee. If all subsystem results are "in," then no signal is provided, and the processing continues with the four steps repeated.

When the result is "out," a signal can be given to the referee in any conventional manner, such as an audio or a visual signal, notifying the referee to stop the play. In addition, the ball path may be provided to the referee or spectators viewing a display screen.

Figure 9:
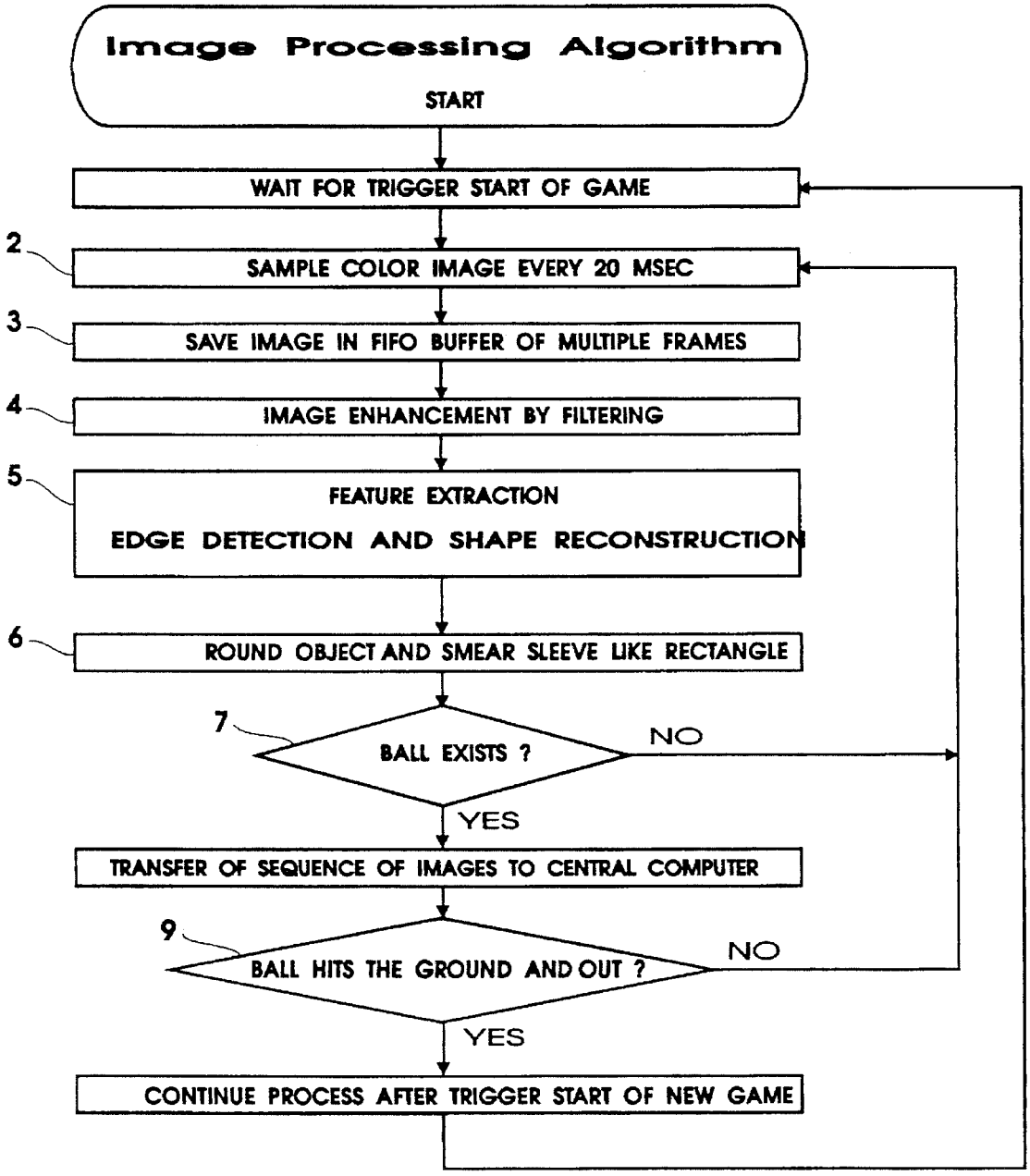
FIG. 9 is a block diagram illustration of the image processing algorithm of the present invention.

FIG. 9 is a block diagram of the image processing algorithm of the system, which applies to each individual line on the court. The diagram is labeled with numerals corresponding to the generally descriptive steps of the algorithm listed below:

1) A subsystem composed of one or two cameras is installed on a dedicated box position outside the tennis court. The elevation of the camera is such to provide the best view of each line (i.e., about 40 cm. to the each side of the line).
2) Image frames are continuously received by the video cameras at frame rate of at least 25 frames per second (50 fields per second), like those received in standard cameras such as the SONY XC-999 or the DALSA DA-512.
3) Each image is sampled and digitized for its picture elements (pixels) and saved in an electronic memory. Each pixel represents a particular spatial location in the image. The last few digitized images (about a half-second thereof) are kept in the system in a cyclic form of first-in first-out. Off-the-shelf frame grabbers can be used to implement this function. The firm Matrox, for example, manufactures such frame grabbers under the product name IMAGE IM-640.
4) Pre-processing mathematical operations are performed by the system electronics to enhance the picture and to reduce noise. Such algorithms are described in an article entitled, "A Fast Two Dimensional Median Filtering," in Anil K. Jain's book *Digital Image Processing,* published by Prentice Hall.
5) A spatial algorithm for feature extraction in the two dimensional image domain is performed in two main stages: (a) edge detection, and (b) shape reconstruction by Hough Transform for the ball-round and smeared sleeve rectilinear shapes. The first stage uses an algorithm similar to one described in the article "A Computational Approach to Edge Detection," by John Cunny in *IEEE Trans on Pattern Analysis and Machine Intelligence,* Vol.

PAMI-8 No. 6, November 1986. The second stage uses one like that described in the article entitled, "A Survey of the Hough Transform," by J. Illingworth and J. Kittler in *Computer Vision Graphics and Image Processing* 44, 87–116 (1988).

6) Image segmentation is done by decomposing the scene into clusters of separate components, including stages of amplitude thresholding, of boundary extraction based on object profiles (e.g., a player's body and racquet), and of texture segmentation (e.g., a ball cover's texture). These functions are provided in MATROX's off-the-shelf IM-VISION s/w library as separate functions: IM-Thresh, IM-Object, and IM-Text.

7) Classification of the object into one of several categories, including geometric forms, texture, and amplitude distribution, is done by symbolic representation of the component clusters and by comparison of each cluster, according to a category decision tree, to known categories of a built-in library. The desired category is the sleeve geometrical shape defined by the line borders 56–61 of FIG. 8, which indicates the ball's presence and the location of its impact on the ground.

8) Using the edge detection technique described in step (5), tennis court line extraction is done on each image to get the location of the borders on the line viewed.

9) The determination of whether the ball is "in" or "out" is done by assessing the point of impact 60 of FIG. 8, relative to the court line.

It will be appreciated that the invention is not limited to what has been described above by way of example. Rather the invention is defined solely by the claims which follow.

We claim:

1. An automatic line officiating system comprising:

a video camera disposed adjacent to a line to be officiated and arranged with the longitudinal axis of a field of view of said video camera concentric with said line to provide image data representing the vicinity of said line;

an image processing system coupled to said video camera and arranged to receive said image data from said video camera, to process said data to determine the path of a ball in said field of view of said video camera, and to provide a determination whether said ball has bounced on or within said line, or outside said line; and cuing apparatus coupled to said video camera for activating the transfer of image data from said camera to said image processing system when said ball is within said field of view of said video camera, wherein said cuing apparatus comprises at least one cuing camera disposed adjacent to said video camera and sharing the same field of view with the video camera.

2. An automatic line officiating system as claimed in claim 1 and wherein said cuing apparatus comprises said at least one camera with frame rates which are at least half an order of magnitude higher than the frame rate of a conventional video camera.

3. An automatic line officiating system as claimed in claim 1 and wherein said cuing apparatus comprises said at least one camera having a shutter modulated with a variable duty-cycle.

4. An automatic line officiating system as claimed in claim 1 and wherein said cuing apparatus comprises at least one line-scan camera disposed so as to view a line parallel to and a few centimeters above the ground.

5. An automatic line officiating system comprising:

a video camera disposed adjacent to a line to be officiated and arranged with the longitudinal axis of a field of view of said video camera concentric with said line to provide image data representing the vicinity of said line;

an image processing system coupled to said video camera and arranged to receive said image data from said video camera, to process said data to determine the path of a ball in said field of view of said video camera, and to provide a determination whether said ball has bounced on or within said line, or outside said line; and cuing apparatus coupled to said video camera for activating the transfer of image data from said camera to said image processing system when said ball is within said field of view of said video camera, wherein said cuing apparatus comprise at least one camera disposed above a court to be officiated and coupled to said video camera.

6. An automatic line officiating system comprising:

a video camera disposed adjacent to a line to be officiated and arranged with the longitudinal axis of a field of view of said video camera concentric with said line to provide image data representing the vicinity of said line;

an image processing system coupled to said video camera and arranged to receive said image data from said video camera, to process said data to determine the path of a ball in said field of view of said video camera, and to provide a determination whether said ball has bounced on or within said line, or outside said line; and a display for displaying an output picture of the path of the ball in the vicinity of said line.

7. A method for automatic line officiating comprising the steps of:

mounting a video camera adjacent to a line to be officiated with the longitudinal axis of a field of view of said video camera concentric with said line;

determining the existence of a ball within the field of view of said camera, said determining step comprising the steps of:

mounting a cuing camera adjacent to said video camera wherein said cuing camera shares the same field of view with said video camera;

viewing said line with said cuing camera; and processing the images originating from said cuing camera to determine whether a ball is within the field of view of said cuing camera; said method for automatic line officiating also comprises:

providing image data from said video camera to an image processing system coupled to said video camera;

processing said image data to provide data corresponding to a path of a ball in the vicinity of said line; and providing in response thereto, a determination whether the ball has bounced on or within said line, or outside said line.

8. A method as claimed in claim 7 and further comprising the step of providing an output picture of the path of the ball in the vicinity of said line.

* * * * *